United States Patent [19]

Adkins

[11] 4,380,895

[45] Apr. 26, 1983

[54] COMBUSTION CHAMBER FOR A GAS TURBINE ENGINE HAVING A VARIABLE RATE DIFFUSER UPSTREAM OF AIR INLET MEANS

[75] Inventor: Richard C. Adkins, Milton Keynes, England

[73] Assignee: Rolls-Royce Limited, London, England

[21] Appl. No.: 274,285

[22] Filed: Jun. 15, 1981

Related U.S. Application Data

[63] Continuation-in-part of Ser. No. 122,272, Feb. 19, 1980, abandoned, and Ser. No. 62,418, Jul. 31, 1979, which is a continuation-in-part of Ser. No. 827,109, Aug. 23, 1977, abandoned.

[30] Foreign Application Priority Data

Sep. 9, 1976 [GB] United Kingdom ..... 37326/76
Feb. 20, 1979 [GB] United Kingdom ..... 7906034

[51] Int. Cl.[3] ..... F02C 7/04; F02C 9/14
[52] U.S. Cl. ..... 60/39.23; 60/751
[58] Field of Search ..... 60/752, 751, 39.27, 60/39.23

[56] References Cited

U.S. PATENT DOCUMENTS 3,577,878 5/1971 Greenwood et al. .
3,631,675 1/1972 Keiter et al. .
3,910,035 10/1975 Juhasz et al. .
4,062,182 12/1977 Fehler et al. .

OTHER PUBLICATIONS

Adkins, R. C., "A Short Diffuser with Low Pressure Loss", Journal of Fluids Eng., Sep. 1975, pp. 297–302.

*Primary Examiner*—Carlton R. Croyle
*Assistant Examiner*—Donald E. Stout
*Attorney, Agent, or Firm*—Cushman, Darby & Cushman

[57] ABSTRACT

A combustion chamber of a gas turbine engine has an upstream variable rate diffuser for controlling the airflow into first and second annular ducts which partially surround the combustion chamber, primary and dilution air flowing into the combustion chamber from the first annular duct and bypass air flowing into the combustion chamber from the second annular duct. The variable rate diffuser comprises a primary duct and downstream fence located in a secondary duct which has a bleed duct with a variable bleed rate, the outlet of the primary duct being smaller in diameter than the inlet to the first annular duct. In operation, by varying the bleed rate, the rate of diffusion into the combustion chamber can be varied, and if the bleed rate is reduced to low bleed conditions at high power conditions or to zero bleed condition at full power condition, vitiated air can be drawn from the combustion chamber and flowed in a reverse direction, upstream along the second annular duct and returned to the combustion chamber at its upstream end whereby the rate of combustion is reduced thereby reducing emissions of $NO_x$.

4 Claims, 3 Drawing Figures

COMBUSTION CHAMBER FOR A GAS TURBINE ENGINE HAVING A VARIABLE RATE DIFFUSER UPSTREAM OF AIR INLET MEANS

This application is a continuation-in-part of copending United States application Ser. No. 122,272, filed Feb. 19, 1980, now abandoned and of copending United States application Ser. No. 62,418, filed July 31, 1979, which, in turn, was a continuation-in-part of United States application Ser. No. 827,109, filed Aug. 23, 1977 (now abandoned).

FIELD OF THE INVENTION

This invention relates to the control of airflow in gas turbine engine combustion chambers for the purpose of reducing harmful exhaust emissions and, more particularly, harmful emission of oxides of nitrogen ($NO_x$) at high and full power operation of a gas turbine engine.

BACKGROUND OF THE INVENTION

The problem of exhaust gas emissions basically manifests itself as an excess of oxides of nitrogen ($NO_x$) at high and full power operation and an excess of carbon monoxide (CO) at low power operation. Techniques have been produced which reduce the $NO_x$ emissions, but these have tended to increase the CO emissions and vice-versa.

The problem originates in the primary zone of the combustor where rapid reaction rates are achieved by using near-stoichiometric mixtures of fuel and air, as a result of which, the temperatures generated are sufficiently high to promote the formation of $NO_x$. The maximum temperature can be reduced by operating at an off-stoichiometric mixture strength, the condition of mixture strength being known as the equivalence ratio ($\phi$) which is defined as the ratio of fuel to air fractions between the operational and the stoichiometric conditions.

The effect of operating the primary zone at off-stoichiometric condition is that the formation of $NO_x$ can be significantly reduced providing that $\phi$ is greater than about 1.2 or less than about 0.8. The fuel rich solution leads to a large combustion chamber, and for aero-engines and their industrial derivatives it is necessary to take the fuel lean solution which in itself has adverse effects when the engine is operating at part load conditions. There is a tendency for $\phi$ and the compressor delivery air temperature to drop, resulting in the emission of large quantities of CO and the likelihood of combustion instability.

One solution to this problem is to use staged combustion in which low power requirements are met entirely by a first stage combustor running at near stoichiometric conditions, while at greater loads, the first stage is used as a torch to ensure stability in a larger, second stage combustor, operating at a lower equivalence ratio. This type of system can be difficult to manufacture, requires a large number of fuelling points and fuel injection systems using pre-mixing, and pre-vaporizing techniques may be required to make combustion adequately homogeneous.

Another solution is to vary the primary zone equivalence ratio by controlling the amount of air flowing into it, and a method and apparatus utilizing a fluidic control of air distribution is disclosed in the aforementioned United States patent application Ser. No. 827,109 (now abandoned) and its continuation-in-part application Ser. No. 62,418.

In those applications there was disclosed a combustion chamber having first and second air inlet means and a variable rate diffuser upstream of both said inlet means, the first air inlet means comprising a first annular duct defined by part of the wall of the combustion chamber and an intermediate casing, the combustion chamber having air inlets for the flow of primary and dilution air from the first annular duct, the second air inlet means comprising a second annular duct surrounding the first annular duct, the second annular duct including a part of the wall of the combustion chamber having air inlets for the flow of bypass air, the variable rate diffuser comprising vortex generating means and a variable rate air bleed, the variable rate diffuser receiving a supply of air and delivering the air to the first and second inlet means in a ratio dependent on the rate of diffusion therein.

The variable rate diffuser typically comprises a primary duct receiving a supply of air located within a secondary duct, a fence in the secondary duct downstream of the outlet of the primary duct and a bleed duct having a variable controllable bleed in the secondary duct upstream of the fence.

BRIEF DESCRIPTION OF THE INVENTION

It has now been found that by modifying the variable rate diffuser so that the outlet diameter of the primary duct of the variable rate diffuser is smaller than the diameter of the first air inlet means of the combustion chamber, and by operating at low and zero bleed conditions when the gas turbine engine is operating at high and full power conditions, the bypass flow in the second annular duct can be reversed so that vitiated air can be drawn back from the combustion chamber reversely along the second annular duct and returned to the first inlet means of the combustion chamber in order to reduce the rate of combustion. This process of recycling vitiated air reduces the emissions of $NO_x$ from the combustion chamber and, thus, from the exhaust nozzle of the gas turbine engine as any remaining products of combustion are exhausted.

The term "vitiated air" is intended to include any bypass air mixed with products of combustion drawn from the combustion chamber or exhaust gases drawn from the combustion chamber. It would also include just products of combustion and/or exhaust gases drawn from the combustion chamber.

BRIEF DESCRIPTION OF THE DRAWINGS

The present invention will now be more particularly described with reference to the accompanying drawings in which.

DETAILED DESCRIPTION OF THE INVENTION

Figure 1:
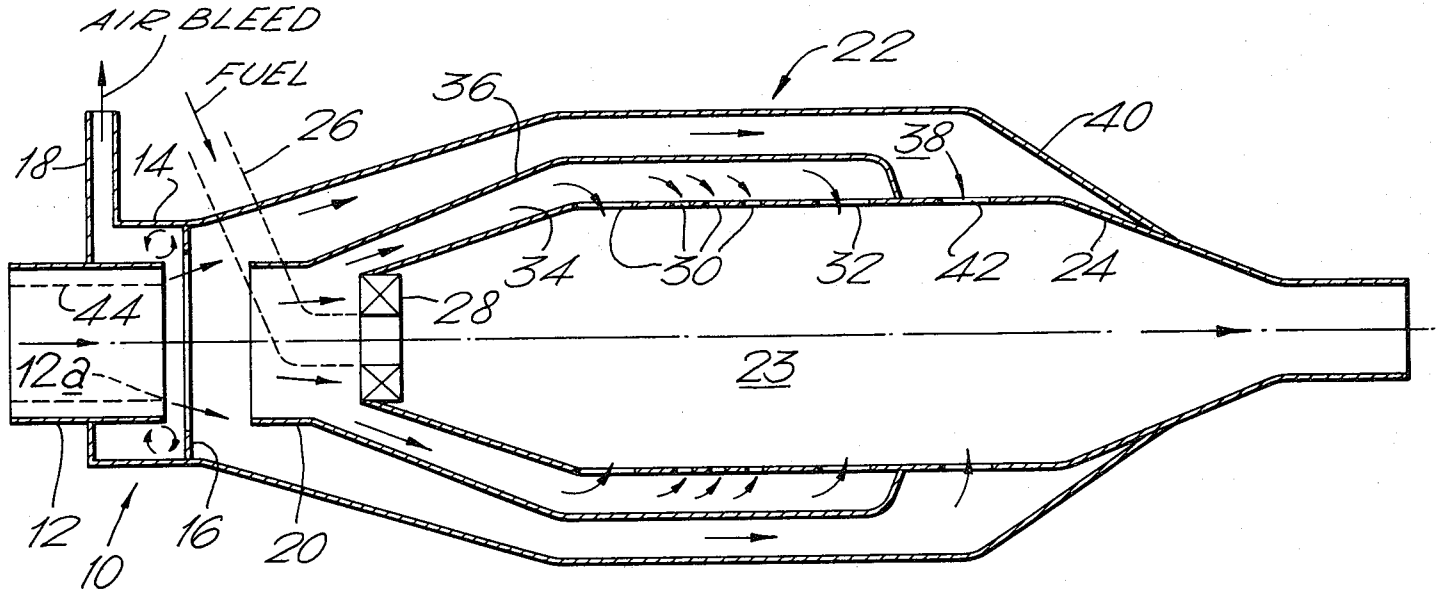
FIG. 1 discloses a combustion apparatus shown in the aforementioned copending applications Ser. No. 827,109 and Ser. No. 62,418.
Figure 2:
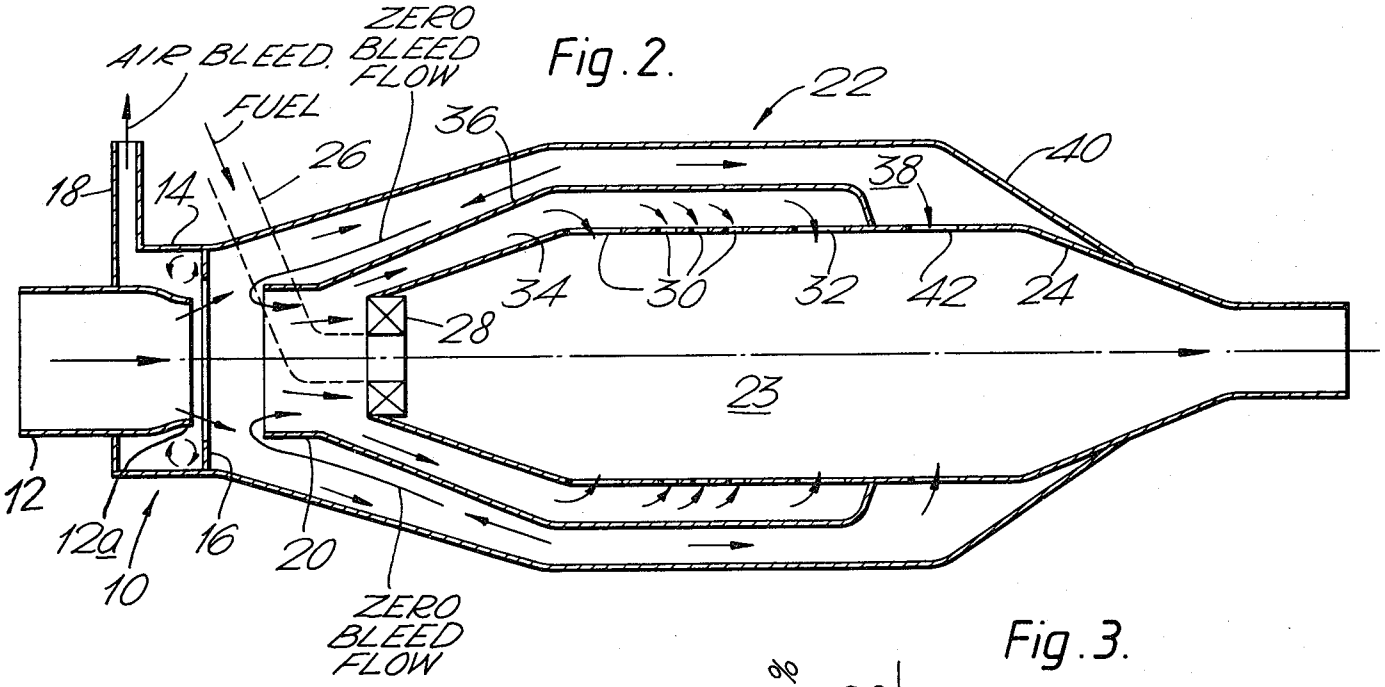
FIG. 2 discloses a combustion apparatus according to the present invention and including a combustion chamber having a variable rate diffuser upstream of its air inlet means.

Referring to FIGS. 1 and 2, a variable rate diffuser is attached to combustion apparatus 22, the diffuser comprising a parallel-walled primary duct 12 located in a secondary duct 14, an annular fence 16 which constitutes a vortex generating means fixed in the secondary duct downstream of the outlet of the primary duct, and a bleed duct 18 in the secondary duct. A capture tube 20, which can be larger, smaller or equal in diameter to the primary duct 12 is positioned in the secondary duct to receive air from the primary duct and together with the secondary duct forms part of the combustion apparatus shown in FIGS. 1 and 2.

The combustion apparatus 22 comprises a combustion chamber 23 defined by a liner 24, having a fuel supply 26, a primary air inlet 28, intermediate air inlets 30 and dilution air inlets 32. A first air inlet means for the combustion chamber 23 includes an annular duct 34 defined by the capture tube 20 and an intermediate casing 36 extending downstream from the capture tube around a part of the exterior wall of the combustion chamber 23. The first annular duct encloses the primary, intermediate and dilution air inlets 28, 30 and 32, respectively. A second or bypass air inlet means for the combustion chamber 23 includes a second annular duct 38 formed by an outer casing 40 surrounding the intermediate casing 36. The duct 38 includes bypass ports 42 for bypass or spillage air, the casing 40 being attached to the secondary tube 14. The spillage or bypass air is not intended to be part of the combustion process but serves to affect the necessary control over the combustion process. The intermediate air inlets, and the dilution air inlets 30 and 32, respectively, are included in the duct 34 to ensure that sufficient pressure is available to give adequate penetration of their air jets into the flame tube. If, on the other hand, these holes were located outside of duct 34 it is likely that the pressure available in the spillage air would be insufficient for good penetration of the jets.

Referring now particularly to FIG. 2, the modification according to the present invention comprises modifying the primary duct 12 of the variable rate diffuser so that instead of being the same diameter as the capture tube 20 as shown in hatched lines in FIG. 1, it is of a smaller diameter and together with the capture tube 20 it constitutes and functions as an ejector 12*a*. In FIG. 2, the reduction in diameter of the primary duct 12 is obtained by fitting a nozzle 12*a* at its exit. In more detail, the primary duct 12 in FIG. 2 is provided with an inwardly converging downstream end or ejector 12*a* which has a diameter less than the diameter of the capture tube 20. An alternative arrangement is shown in chain lines in FIG. 1, and in this arrangement the ejector 12*a* can be a cylindrical walled tube, as indicated at 44, the tube being similar to the tube 12 in FIG. 1 but being of smaller diameter than the capture tube 20. The remainder of the diffuser 10 and combustion apparatus 22 of FIG. 2 have been described with reference to FIG. 1 and will not be repeated herein.

In operation, the combustion apparatus 22 of FIG. 2 provides for reduction of the emissions of $NO_x$ from the combustion chamber 23 and exhaust nozzle of the gas turbine engine (not shown). As pointed out in the introductory portion of the specification, the emissions of $NO_x$ are greatest at high and full power conditions of the gas turbine engine. With the present invention, the variable rate bleed is utilized to reduce these emissions by reducing the bleed through the duct 18 for high power conditions, this reduction being to zero for full power conditions. When the bleed rate through the duct 18 is so reduced, the ejector 12*a*, because of its reduced diameter relative to the capture tube 20, causes a reversal of flow in the second annular duct 38, and such reversal of flow will function to draw vitiated air from the combustion chamber 23 through the port 42. This vitiated air travelling in an upstream direction through the second annular duct 38 is discharged therefrom into the first air inlet means of the first annular duct 34, and it will then pass into the combustion chamber 23 through any of the primary, intermediate and dilution air inlets 28, 30 and 32, respectively, along with at least some of the air discharged from the tube 12 and ejector 12*a*.

Figure 3:
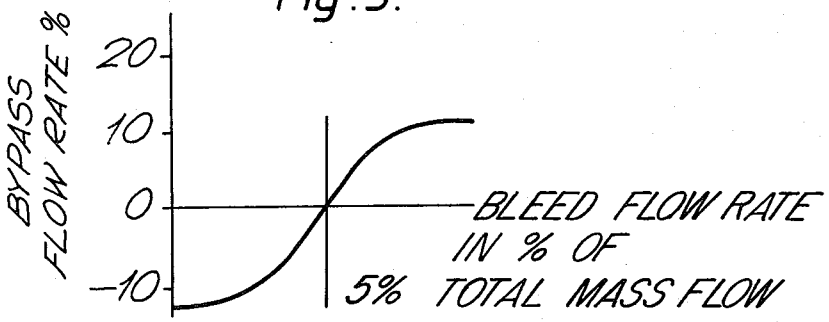
FIG. 3 is a graph disclosing the relationship between bypass flow rate and bleed flow rate in percent of total mass flow entering the combustion apparatus and flowing through the combustion chamber.

The graph of FIG. 3 discloses a typical situation with respect to the operation of the combustion apparatus 22 of the present invention. In this respect, it will be noted that at a bleed flow rate through the bleed duct 18 of about 5% of the total mass flow through the combustion chamber 23, there is zero flow of bypass air in the second annular duct 38. On the other hand, when the bleed flow rate in percent of total mass flow through the combustion chamber is above 5%, there is a positive and downstream flow through the bypass or second annular duct 38. When the bleed flow rate drops below 5% of the total mass flow through the combustion chamber, there is a negative bypass flow rate in the annular duct 38, and this negative flow rate is a reversal or upstream flow which causes vitiated air to be drawn from the combustion chamber 23 through the port 42 and then discharged into the inlet of the first air inlet means.

The process of recycling vitiated air reduces the emissions of $NO_x$ because it slows-down the rate of combustion in the primary zone of the combustor. An additional advantage of the present invention is that the hot vitiated air could be used to promote pre-vaporization of fuel.

The terms used throughout the specification are for the purpose of description and not limitation as the scope of the invention is defined in the appended claims.

I claim:

1. A combustion chamber apparatus comprising a chamber having first and second air inlet means and a variable rate diffuser upstream of both of said first and second air inlet means, said first air inlet means comprising a first annular duct defined by part of the wall of the combustion chamber and an intermediate casing, said combustion chamber having inlets for the flow of primary, secondary and dilution air from the first annular duct, said second air inlet means comprising a second annular duct, said second annular duct including a part of the wall of said combustion chamber having air inlets for flow of bypass air, said variable rate diffuser comprising a primary duct arranged to receive a supply of compressed air and having a downstream facing outlet, said primary duct being located in a secondary duct, a fence in said secondary duct downstream of the outlet of said primary duct and downstream of a bleed duct having a variable rate bleed, said bleed duct being in said secondary duct upstream of said fence and capable of being controlled to low and zero bleed conditions, said outlet of said primary duct being smaller in diameter than the diameter of the first air inlet means of the combustion chamber whereby flow of fluid in said second annular duct is reversed and drawn from said combustion chamber and is discharged from said second duct into said first air inlet means and then into said combustion chamber when said variable rate bleed duct is controlled to low and zero bleed conditions.

2. A combustion apparatus as claimed in claim 1 in which said outlet for said primary duct is defined by an inwardly converging downstream end of said primary duct.

3. A combustion apparatus as claimed in claim 1 in which said primary duct has a cylindrical downstream end defining said outlet.

4. A combustion apparatus as claimed in claims 1, 2 or 3 in which said first air inlet means includes a cylindrical capture tube extending upstream from said intermediate casing and spaced downstream from said fence.

* * * * *